United States Patent [19]

Forberg et al.

[11] 4,412,374

[45] Nov. 1, 1983

[54] DEVICE FOR CLAMPING AN INSULATED CABLE WIRE TO A TERMINAL ELEMENT

[75] Inventors: Horst Forberg; Klaus-Peter Achtnig; Anneliese Stoewe, all of Berlin, Fed. Rep. of Germany

[73] Assignee: Krone GmbH, Berlin, Fed. Rep. of Germany

[21] Appl. No.: 265,979

[22] Filed: May 21, 1981

[30] Foreign Application Priority Data

Oct. 29, 1980 [DE] Fed. Rep. of Germany ..... 3040709

[51] Int. Cl.[3] ..... H01R 43/00

[52] U.S. Cl. ..... 29/566.4; 7/107; 29/33 M; 29/278; 29/751

[58] Field of Search ..... 29/566.4, 748, 750, 29/751, 752, 747, 278, 33 M, 56.5, 566.1, 566.2, 566.3; 7/158, 107

[56] References Cited

U.S. PATENT DOCUMENTS 3,628,202 12/1971 Brown et al. ..... 29/748 X
3,708,852 1/1973 Mason ..... 29/566.4
4,300,282 11/1981 Bunyea et al. ..... 29/751
4,327,485 5/1982 Rix ..... 29/751

*Primary Examiner*—Z. R. Bilinsky
*Attorney, Agent, or Firm*—Brown & Martin

[57] ABSTRACT

The subject-matter of the invention is a device for electrically clamping or connecting a cable wire in the longitudinal slot of an upright terminal element, the laterally deflectable legs and lugs of which are not supported at their sides, e.g. by a plastic material. The device comprises a plunger (1) adapted to be longitudinally movable within a housing against the action of a coil spring (4) and carrying at its forward end a pressure member (1*a*). Said pressure member (1*a*) is disposed to be movable within a sleeve (3) fixed to the housing and has a shape matching the cross-sectional configuration of the terminal element. The projecting sleeve surrounds the outer faces of the components of the terminal element and supports the same laterally during the clamping operation. Furthermore the sleeve (3) comprises a cutting edge (3*a*) cooperating with a cutting edge formed on the pressure member (1*a*).

6 Claims, 5 Drawing Figures

Fig.3a
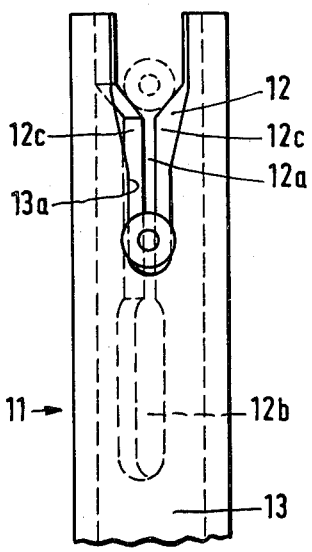
Fig.3b
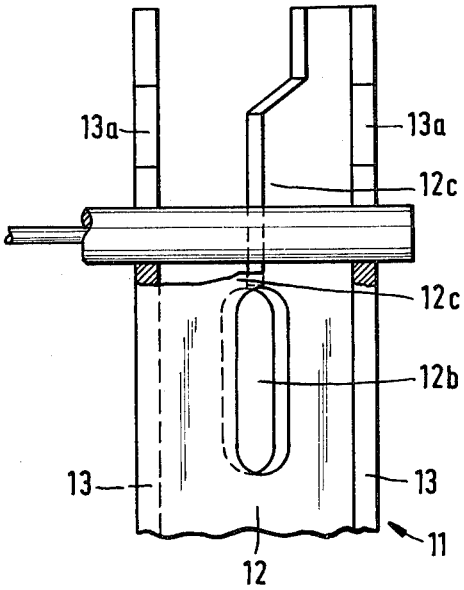
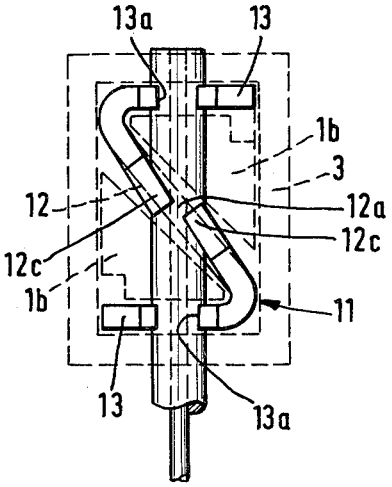
Fig.3

DEVICE FOR CLAMPING AN INSULATED CABLE WIRE TO A TERMINAL ELEMENT

The present invention relates to a device for electrically clamping or connecting an insulated cable wire to an upright terminal element, comprising a plunger mounted within a housing for longitudinal movement therein and carrying a pressure member at its free forward end.

The present invention is particularly useful in the field of telecommunication, viz., for the solderless, screwless and stripless wiring of telephone equipment.

In the solderless, screwless and stripless connecting technique developed by the applicants it is possible to make electrical connections between a cable wire and a terminal element, which connections are of excellent mechanical strength and permanently corrosion-resistant, wherein it is not required either to bare the cable or to provide screwed or soldered connections.

This solderless, screwless and stripless connecting technique normally employs terminal elements mounted on a carrier and having at least one longitudinal slot of a predetermined length and having a width slightly smaller than the diameter of the conductive wire. One end of the wire is urged transversely into said slot, whereby the members defining the slots and being adapted to be resiliently deformed to a predetermined extent are laterally displaced such that their sharp edges will severe the insulation and penetrate to a predetermined extent into the material of the wire.

For performing such a connecting or clamping operation tools and devices have been known which comprise a plunger and/or a slide mounted within a housing so as to be longitudinally movable against the action of a spring, the plunger and/or slide being fixedly connected at its forward end with a member such as a longitudinally slotted clamping head. An insulated cable wire is loosely placed into an enlarged entry opening of the slot and after application of the clamping tool will be urged into the slot by an advance movement of the plunger of the slide brought about either manually or by means of a motor. The completion of the connecting operation is indicated by the springing-back of a snap mechanism.

Until recently it was common practice to externally support the terminal elements at least partially by a resilient plastic material so that upon depression of the cable wires the laterally deflected lugs were sufficiently supported. However, such lateral support has some consequent structural expenditure and, above all, requires a certain space thus limiting the objective of minimizing the sizes of exchange connections and of wiring standardized exchange connections with a greater number of cable wires.

It is therefore the object of the present invention to provide a device of the type specified above which makes it possible to make electrical clamping connections between cable wires and upright, laterally unsupported terminal elements in a reliable and simple way.

In accordance with the present invention the above object is solved in that within the housing there is disposed a sleeve enclosing the plunger at least along a portion of its length, the longitudinally free end portion of said sleeve projecting beyond the pressure member integrally formed with the plunger and laterally supporting the lugs of the terminal element either before or during the connecting operation.

To obtain a reliable positive connection between the wire material of the cable and the sharp edges of the terminal element slot, the forward end portion of the pressure member also is designed in such a manner that the side faces of two sectional elongated webs defining an obliquely extending central slot will engage at the corresponding side faces of the contact portion of the terminal element.

To this end the pressure member which is movable within the sleeve is formed with an obliquely extending slot defined between two sectional webs, said slot being adapted to locate the central longitudinally slotted contact portion of the terminal element on either side.

Because of the extremely limited available space it is very difficult to sever the free ends of the cable wires with separate tools such as scissors. Thus a significant further development of the present invention resides in that a part of the sleeve wall is designed as a cutting edge which after completion of the connecting operation will sever the cable end due to a further advance movement of the device and in cooperation with a cutting edge formed at the pressure member.

An embodiment of the device according to the present invention will be described in detail below with reference to the accompanying drawing, in which:

FIG. 3 is a plan view of a terminal element including a connected cable wire; and FIGS. 3*a*, 3*b* are respectively side views of the terminal element including a connected cable wire.

Figure 1:
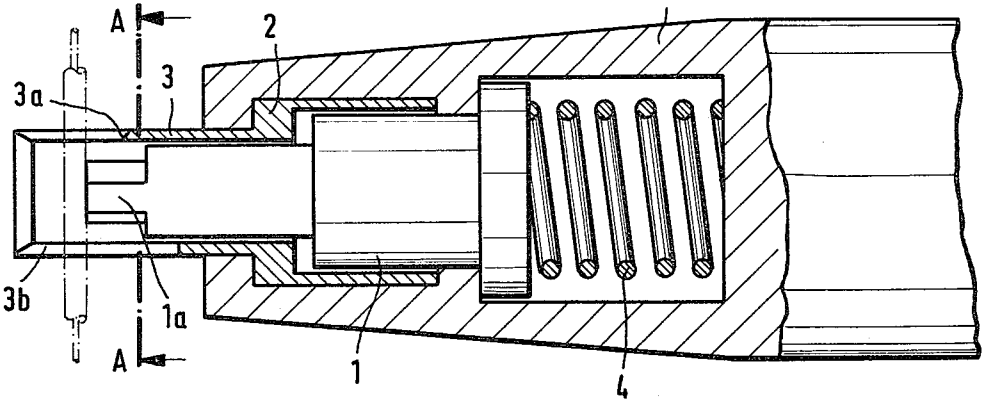
FIG. 1 is an axial sectional view of the clamping device.
Figure 2:
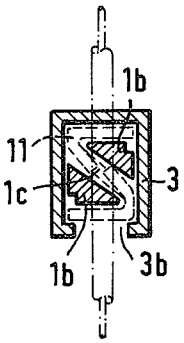
FIG. 2 is a sectional view of the sleeve and the pressure member of the device shown in FIG. 1 along the line A—A of FIG. 1.

The device shown in FIGS. 1 and 2 comprises a step-like tapering plunger 1, the widened rear end portion of which rests against a coil spring 4 disposed within a cavity of a housing 5. The forward and central portions of the plunger 1 are guided within a sleeve 2 to be movable longitudinally. The forward end portion of the plunger 1 is formed with a pressure member 1*a* which—as shown in FIG. 2—has an obliquely extending longitudinal slot 1*c* defined by two sectional webs 16. The forward portion 3 of the sleeve, which has its widened rear portion 2 located within the housing 5, projects beyond the front edge of the pressure member 1*a* in the position shown in FIG. 1. Also, a cutting edge 3*a* is formed in said forward end of the sleeve, which cutting edge is opposed by a longitudinal slot 3*b* of greater length. The cutting edge 3*a* cooperates with the bottom of support slots 13*a* and the adjacent side of the terminal element to sever one end of the wire.

As shown by the broken line in FIG. 3, the sleeve portion 3, before and during the actual clamping operation, encloses a terminal element 11 having Z-shaped cross-section. Each lateral leg 13 of the terminal element 11 is formed with a longitudinal slot 13*a* having a predetermined length (cf. FIGS. 3*a*, 3*b*), the rounded-off bottom of the slot forming an abutment for the insulation of the cable wire when completely inserted. The central portion of the Z-shaped terminal element forms the actual contact portion 12 and includes a longitudinal slot 12*a* of greater length which in its lower portion 12*b* has a greater width for the purpose of achieving a spring action of two lugs 12*c* cutting into the material of the wire.

The operation of the device according to the present invention will now be described. A cable wire is placed loosely into the widened entry opening of the slots 13*a* as shown in broken lines in FIG. 3*a*. Then the longitudinally slotted sleeve is placed onto the terminal element such that the two projecting portions of the cable wire will slide into the longitudinal slot of the sleeve and the sleeve wall will engage directly adjacent the outer faces of the legs 13 of the terminal element when the device is advanced. The longitudinal slots formed in the sleeve are selected such that upon further advancing movement the pressure member 1*a* will rest in the manner shown in FIG. 3 on the central portions of the cable wire and will urge the same towards the bottom of the slots 13*a* into the terminal element.

Further advancing movement of the housing 5 will cause further movement of the sleeve relative to the plunger 1 and the pressure member 1*a* so that the cutting edges will become operative and will transversely severe a projecting end of the cable wire at a predetermined distance. This completes the connecting operation so that the device may be removed.

We claim:

1. A device for electrically connecting an insulated thin cable wire to an upright terminal element, said terminal element being formed with spaced parallel legs interconnected by means of a slotted contact portion at an oblique angle with respect to said legs, said legs having support slots aligned with said contact portion slot, said device comprising:

a hollow housing;

a sleeve disposed in said housing and projecting from one end thereof, said sleeve having oppositely aligned slots opening into the distal end of said sleeve;

a plunger mounted within said housing for limited longitudinal movement therein, said plunger having a pressure member extending outwardly from said housing and within said distal end of said sleeve, said distal end of said sleeve projecting beyond said pressure member, said pressure member being adapted to engage the wire;

said sleeve being adapted to circumscribe and support said legs of said terminal when said pressure member engages the wire at the top of said terminal and upon insertion of the wire into said contact slot, said sleeve slots encompassing and confining the wire on both sides of said terminal element at all times when said pressure member contacts the wire.

2. The device recited in claim 1 wherein one of said sleeve slots is shorter than the other, said one slot being formed as a cutting edge to cut one end of said wire when said sleeve is forced down onto said terminal with respect to said plunger.

3. The device recited in claim 1, wherein said terminal element is of Z-shaped cross section, said support slots in said legs are wider and shorter than said slot in said oblique contact portion to provide support for the insulation covered wire, said sleeve having a rectangular cross section to encompass said spaced parallel legs of said terminal element.

4. The device recited in claim 2 wherein said terminal element is of Z-shaped cross section, said support slots in said legs are wider and shorter than said slot in said oblique contact portion to provide support for the insulation covered wire, said sleeve having a rectangular cross section to encompass said spaced parallel legs of said terminal element.

5. The device recited in claim 1 or 2 wherein said pressure member, movable within said sleeve, is formed with an obliquely extending slot defined between two sectional webs, said obliquely extending slot being adapted to receive said slotted contact portion of said terminal element.

6. The device recited in claim 5 wherein said terminal element is of Z-shaped cross section, said support slots in said legs are wider and shorter than said slot in said oblique contact portion to provide support for the insulation covered wire, said sleeve having a rectangular cross section to encompass said spaced parallel legs of said terminal element.

* * * * *